US010741037B2

(12) United States Patent
Chavez

(10) Patent No.: US 10,741,037 B2
(45) Date of Patent: Aug. 11, 2020

(54) METHOD AND SYSTEM FOR DETECTING INAUDIBLE SOUNDS

(71) Applicant: Avaya Inc., Santa Clara, CA (US)

(72) Inventor: David Chavez, Broomfield, CO (US)

(73) Assignee: Avaya Inc., Santa Clara, CA (US)

( * ) Notice: Subject to any disclaimer, the term of this patent is extended or adjusted under 35 U.S.C. 154(b) by 0 days.

(21) Appl. No.: 15/981,184

(22) Filed: May 16, 2018

(65) Prior Publication Data

US 2019/0355229 A1 Nov. 21, 2019

(51) Int. Cl.

| | |
|---|---|
| ***G08B 21/02*** | (2006.01) |
| ***G08B 21/18*** | (2006.01) |
| ***G08B 13/16*** | (2006.01) |

(52) U.S. Cl.

CPC ..... *G08B 21/02* (2013.01); *G08B 21/182* (2013.01); *G08B 13/1681* (2013.01)

(58) Field of Classification Search

CPC ... G08B 21/02; G08B 21/182; G08B 13/1681
See application file for complete search history.

(56) References Cited

U.S. PATENT DOCUMENTS 3,854,129 A * 12/1974 Haselton ..... G08B 13/1681 340/544
3,898,640 A * 8/1975 Hossbach ..... G08B 13/1609 367/93
4,023,456 A * 5/1977 Groeschel ..... G10H 1/005 84/115
4,110,017 A * 8/1978 McCormack ..... A63J 5/04 352/10
4,800,293 A * 1/1989 Miller ..... G08B 13/1681 307/116
4,928,085 A * 5/1990 DuRand, III ..... G08B 13/1681 340/544
4,975,800 A * 12/1990 Oshita ..... G01R 31/3274 324/520
5,147,977 A * 9/1992 Reichert ..... F42C 11/007 102/211
5,185,593 A * 2/1993 DuRand, III ..... G08B 13/1681 340/544
5,793,286 A * 8/1998 Greene ..... G08B 29/183 340/522
7,035,807 B1 * 4/2006 Brittain ..... G11B 27/034 704/278
8,983,089 B1 * 3/2015 Chu ..... H04R 3/005 381/58
9,092,964 B1 * 7/2015 Chan ..... G08B 21/02
9,704,361 B1 * 7/2017 Hazlewood ..... G05B 15/02
(Continued)

OTHER PUBLICATIONS

Goodin "More Android phones than ever are covertly listening for inaudible sounds in ads," ars technica, May 5, 2017, 5 pages [retrieved online from: arstechnica.com/information-technology/2017/05/theres-a-spike-in-android-apps-that-covertly-listen-for-inaudible-sounds-in-ads/].

*Primary Examiner* — Joseph H Feild
*Assistant Examiner* — Rufus C Point
(74) *Attorney, Agent, or Firm* — Sheridan Ross P.C.

(57) ABSTRACT

The methods and systems of the present disclosure can monitor, by a microprocessor of a first device, changes in pressure over time at the first device; detect, by the microprocessor, a first measurement in the pressure over time; and provide, by the microprocessor, a first alert based on the detection of the first measurement.

19 Claims, 6 Drawing Sheets

(56) References Cited

U.S. PATENT DOCUMENTS 9,886,833 B2 * 2/2018 Noland ..... G08B 13/1672
2003/0090377 A1 * 5/2003 Pieper ..... G08B 13/1681 340/566
2004/0246124 A1 * 12/2004 Reilly ..... G01S 13/56 340/511
2007/0237345 A1 * 10/2007 Zhang ..... H04R 19/016 381/113
2008/0007396 A1 * 1/2008 Parkulo ..... G01S 13/878 340/539.2
2008/0275349 A1 * 11/2008 Halperin ..... A61B 5/0205 600/484
2009/0233641 A1 * 9/2009 Kanazawa ..... H04B 17/23 455/550.1
2010/0046115 A1 * 2/2010 Lammel ..... G01P 3/62 360/110
2010/0142715 A1 * 6/2010 Goldstein ..... G06F 16/686 381/56
2010/0229784 A1 * 9/2010 Bayne ..... F42D 5/00 116/203
2011/0000389 A1 * 1/2011 Fullerton ..... F41H 11/12 102/335
2011/0235465 A1 * 9/2011 Bostick ..... F41H 13/0081 367/99
2012/0029314 A1 * 2/2012 Paquet ..... A61B 5/02055 600/301
2012/0170412 A1 * 7/2012 Calhoun ..... G01S 3/8083 367/118
2012/0282886 A1 * 11/2012 Amis ..... G06F 3/016 455/404.2
2013/0241727 A1 * 9/2013 Coulombe ..... G08B 23/00 340/517
2014/0056172 A1 * 2/2014 Lee ..... H04W 4/70 370/254
2014/0091924 A1 * 4/2014 Armitage ..... G08B 21/0415 340/539.11
2014/0266702 A1 * 9/2014 Forster-Knight ..... H04W 4/90 340/539.13
2014/0333432 A1 * 11/2014 Armitage ..... G08B 21/0261 340/539.11
2014/0361886 A1 12/2014 Cowdry
2015/0071038 A1 * 3/2015 Boyden ..... G01S 5/18 367/129
2015/0150510 A1 * 6/2015 Leopardi ..... A61B 3/16 600/398
2015/0192414 A1 * 7/2015 Das ..... G01C 5/06 73/384
2015/0195693 A1 * 7/2015 Hooriani ..... H04W 4/90 455/404.2
2015/0279181 A1 * 10/2015 Park ..... G08B 13/1672 367/136
2015/0287317 A1 * 10/2015 Chan ..... G08B 21/02 340/539.12
2015/0310714 A1 * 10/2015 Loveland ..... G08B 21/22 340/539.11
2016/0232774 A1 * 8/2016 Noland ..... G08B 13/1672
2016/0295978 A1 * 10/2016 Hyde ..... A61H 3/02
2016/0335879 A1 * 11/2016 Carr ..... G08B 25/006
2016/0361070 A1 * 12/2016 Ardel ..... A61B 17/1626
2016/0366085 A1 * 12/2016 Touloumtzis ..... H04L 67/24
2017/0132888 A1 * 5/2017 Conlon ..... G08B 13/00
2017/0277947 A1 * 9/2017 Burke ..... G06K 9/00496
2018/0318475 A1 * 11/2018 Thomson ..... A61M 1/0031
2019/0053761 A1 * 2/2019 Young ..... A61B 5/0205

* cited by examiner

METHOD AND SYSTEM FOR DETECTING INAUDIBLE SOUNDS

FIELD

The disclosure relates generally to communications and particularly to sound detection and alerting for communication systems.

BACKGROUND

Sounds include audible and inaudible sound waves. Frequency ranges of sounds that are audible to humans vary based on the individual but commonly are said to include a range of 20 to 20,000 hertz (Hz). Different species have varying abilities to hear sounds of different frequency ranges, and many animals are capable of hearing and detecting sounds that most people cannot hear or feel. For example, the ability to detect sound vibrations and sounds below the range in which humans can hear is common in elephants, whales, and other animals. Unlike people, animals may be alerted to danger when sound vibrations are detected that are inaudible to humans. However, humans may be susceptible to danger when inaudible frequencies are occurring because they may not be aware that such sounds are occurring.

For example, low frequency sound exposure for even short periods of time can cause damage to humans, such as temporary or permanent hearing loss and other physical changes (e.g., confusion, mood changes, and headaches, among others). Oftentimes, the low frequency harmful sounds are inaudible or undetectable to the people being harmed by them.

Another problem is the fact that people can lose their range of hearing due to various factors, including age, injury, infection, and exposure to toxins. In addition, people may be born with a limited or missing ability to hear. Thus, sounds can occur without people's awareness regardless of whether they are at a harmful frequency or not. In addition, there can be security concerns associated with sounds, including inaudible sounds. For example, electronic applications can use inaudible or undetectable sounds to gain information (e.g., by bypassing security systems to gain access to personal data) so that a targeted user could be completely unaware that data is being collected without their consent. Also, as discussed above, sounds (such as low frequency sound exposure) can be used as a weapon.

SUMMARY

Thus, if a sound is occurring, people may not be immediately aware that it is occurring, and a method and system to notify the person of the sound would be useful. This may be even more useful if a harmful sound is occurring and people are not immediately aware that it is occurring; methods and systems to notify the person of the sound to prevent or reduce any harm being done are desired. Even if a non-harmful sound is occurring that may not be noticed by a person (e.g., due to a hearing impairment), it could be useful to notify the person of the sound.

In communications systems, devices have the ability to monitor surroundings and notify people. Settings related to the monitoring and notifying are customizable and configurable by a user or by an administrator. For example, a user's device has the ability to communicate notifications to the user, and these notifications can be triggered by various criteria. Therefore, methods and systems of monitoring and detecting sounds are needed that can provide a notification (also referred to herein as alert and/or alarm) that the sound is occurring. In embodiments disclosed herein, the sounds may be dangerous or benign and they may be inaudible to all humans, inaudible to some humans, or audible to some or all humans.

The present disclosure is advantageously directed to systems and methods that address these and other needs by providing detection of sounds, including inaudible sounds, and notifying a user (also referred to herein as a person and/or party) in some manner. A user, as described herein, includes a user of a device that detects the sounds or receives a notification and as such may be referred to as a recipient and/or a receiving user.

The notification may be sent to a person, a group of people, and/or a service, and may be sent using a recipient's mobile device and/or other devices. The notifications described herein are customizable and can be an option presented and configurable by a user, or configurable by an administrator. In embodiments of the present disclosure, sounds are detected using built-in sensors on a device (e.g., a microphone), and a user is notified of the sounds by the device or systems associated with the device.

In various embodiments of the present disclosure, inaudible dangerous sounds are detected using built-in sensors on a device (e.g., a microphone), and a recipient is notified by the device (or systems or other devices associated with the device) of the danger from the inaudible dangerous sounds.

Embodiments disclosed herein can advantageously provide sound detection methods and systems that enable the monitoring of sounds that are occurring. Embodiments disclosed herein provide improved monitoring systems and methods that can detect and analyze sounds, and notify a recipient when there is a specified sound occurring.

Such embodiments are advantageous because, for example, they allow users to monitor for and detect specified sounds that are occurring, even if the sounds are inaudible.

Embodiments of the present disclosure include systems and method that can actively monitor an auditory environment. Users and/or devices may or may not be located in the auditory environment at the time the sound is occurring.

In certain aspects, an application, microphone, and/or one or more vibrational sensors send an alarm to a user (or to a service) if a mobile device detects unsafe inaudible sounds. In embodiments of this disclosure, an ultrasonic, inaudible attack can trigger a user's mobile device microphone and/or sensor to detect the sound, and a processor to analyze the sound and alert the user that a certain sound/attack is happening, thereby allowing the user to take protective measures such as getting to a safe place.

Embodiments of the present disclosure can also monitor for cross-device tracking to detect sounds that are used to track devices (e.g., "audio beacons"). This includes instances when an advertisement is used with an undercurrent of inaudible sound that links to a user's device, so that when a user hears an advertisement, the user can be paired to devices. Based on the pairing, cookies can be used to track personal information such as viewing and purchasing information. Embodiments disclosed herein can alert the user that a sound is occurring that may be used for electronic tracking, and that pairing and data collection may be taking place.

Additional embodiments include the use of a recording system or method to record the sounds. The recording can be automatic (e.g., triggered by the detection of a specified sound) and customizable. The recording can be an option presented and configurable by a user, or configurable by an administrator. Such a system can be used, for example, by people who are hearing impaired.

Non-essential notifications and/or recordings can be customized and may be defined as notifications and recordings relating to sounds that do not occur at frequencies harmful to humans. As one example of such customization, notifications and/or recordings may have no alert upon detection and/or receipt when received but then an alert may appear when an interface is opened by a receiving user.

Embodiments herein can provide the ability to detect sounds whereby the person located at within the auditory environment (e.g., at a location where the sound is occurring) can designate one or more notifications to occur upon detection of the sound. Additionally, the person can customize various notifications to occur based on the detection of various sounds. Notifications can be any auditory, visual, or haptic indication. The system may push the notifications in any manner, for example the system and/or device(s) may not give an indication unless the recipient is in a dialog window. In addition, the notification can appear in a message (such as a text message, email, etc.), so that the person sees the notification upon checking the messages.

Therefore, embodiments herein can advantageously monitor various sounds that are occurring and provide notifications of such sounds, as well as recordings of such sounds. These and other needs are addressed by the various aspects, embodiments, and/or configurations of the present disclosure.

Embodiments of the present disclosure are directed towards a method, comprising:

monitoring, by a microprocessor of a first device, changes in pressure over time at the first device;

detecting, by the microprocessor, a first measurement in the pressure over time; and providing, by the microprocessor, a first alert based on the detection of the first measurement.

These and other advantages will be apparent from the disclosure.

The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

The term "a" or "an" entity refers to one or more of that entity. As such, the terms "a" (or "an"), "one or more" and "at least one" can be used interchangeably herein. It is also to be noted that the terms "comprising", "including", and "having" can be used interchangeably.

The term "automatic" and variations thereof refers to any process or operation done without material human input when the process or operation is performed. However, a process or operation can be automatic, even though performance of the process or operation uses material or immaterial human input, if the input is received before performance of the process or operation. Human input is deemed to be material if such input influences how the process or operation will be performed. Human input that consents to the performance of the process or operation is not deemed to be "material".

The term "communication event" and its inflected forms includes: (i) a voice communication event, including but not limited to a voice telephone call or session, the event being in a voice media format, or (ii) a visual communication event, the event being in a video media format or an image-based media format, or (iii) a textual communication event, including but not limited to instant messaging, internet relay chat, e-mail, short-message-service, Usenet-like postings, etc., the event being in a text media format, or (iv) any combination of (i), (ii), and (iii).

The term "computer-readable medium" refers to any storage and/or transmission medium that participate in providing instructions to a processor for execution. Such a medium is commonly tangible and non-transient and can take many forms, including but not limited to, non-volatile media, volatile media, and transmission media and includes without limitation random access memory ("RAM"), read only memory ("ROM"), and the like. Non-volatile media includes, for example, NVRAM, or magnetic or optical disks. Volatile media includes dynamic memory, such as main memory. Common forms of computer-readable media include, for example, a floppy disk (including without limitation a Bernoulli cartridge, ZIP drive, and JAZ drive), a flexible disk, hard disk, magnetic tape or cassettes, or any other magnetic medium, magneto-optical medium, a digital video disk (such as CD-ROM), any other optical medium, punch cards, paper tape, any other physical medium with patterns of holes, a RAM, a PROM, and EPROM, a FLASH-EPROM, a solid state medium like a memory card, any other memory chip or cartridge, a carrier wave as described hereinafter, or any other medium from which a computer can read. A digital file attachment to e-mail or other self-contained information archive or set of archives is considered a distribution medium equivalent to a tangible storage medium. When the computer-readable media is configured as a database, it is to be understood that the database may be any type of database, such as relational, hierarchical, object-oriented, and/or the like. Accordingly, the disclosure is considered to include a tangible storage medium or distribution medium and prior art-recognized equivalents and successor media, in which the software implementations of the present disclosure are stored. Computer-readable storage medium commonly excludes transient storage media, particularly electrical, magnetic, electromagnetic, optical, magneto-optical signals.

A "database" is an organized collection of data held in a computer. The data is typically organized to model relevant aspects of reality (for example, the availability of specific types of inventory), in a way that supports processes requiring this information (for example, finding a specified type of inventory). The organization schema or model for the data can, for example, be hierarchical, network, relational, entity-relationship, object, document, XML, entity-attribute-value model, star schema, object-relational, associative, multidimensional, multivalue, semantic, and other database designs. Database types include, for example, active, cloud, data warehouse, deductive, distributed, document-oriented, embedded, end-user, federated, graph, hypertext, hypermedia, in-memory, knowledge base, mobile, operational, parallel, probabilistic, real-time, spatial, temporal, terminology-oriented, and unstructured databases. "Database management systems" (DBMSs) are specially designed applications that interact with the user, other applications, and the database itself to capture and analyze data.

The terms "determine", "calculate" and "compute," and variations thereof, are used interchangeably and include any type of methodology, process, mathematical operation or technique.

The term "electronic address" refers to any contactable address, including a telephone number, instant message handle, e-mail address, Universal Resource Locator ("URL"), Universal Resource Identifier ("URI"), Address of Record ("AOR"), electronic alias in a database, like addresses, and combinations thereof.

An "enterprise" refers to a business and/or governmental organization, such as a corporation, partnership, joint venture, agency, military branch, and the like.

A "geographic information system" (GIS) is a system to capture, store, manipulate, analyze, manage, and present all types of geographical data. A GIS can be thought of as a system—it digitally makes and "manipulates" spatial areas that may be jurisdictional, purpose, or application-oriented. In a general sense, GIS describes any information system that integrates, stores, edits, analyzes, shares, and displays geographic information for informing decision making.

The terms "instant message" and "instant messaging" refer to a form of real-time text communication between two or more people, typically based on typed text. Instant messaging can be a communication event.

The term "internet search engine" refers to a web search engine designed to search for information on the World Wide Web and FTP servers. The search results are generally presented in a list of results often referred to as SERPS, or "search engine results pages". The information may consist of web pages, images, information and other types of files. Some search engines also mine data available in databases or open directories. Web search engines work by storing information about many web pages, which they retrieve from the html itself. These pages are retrieved by a Web crawler (sometimes also known as a spider)—an automated Web browser which follows every link on the site. The contents of each page are then analyzed to determine how it should be indexed (for example, words are extracted from the titles, headings, or special fields called meta tags). Data about web pages are stored in an index database for use in later queries. Some search engines, such as Google™, store all or part of the source page (referred to as a cache) as well as information about the web pages, whereas others, such as AltaVista™, store every word of every page they find.

The term "means" as used herein shall be given its broadest possible interpretation in accordance with 35 U.S.C., Section 112, Paragraph 6. Accordingly, a claim incorporating the term "means" shall cover all structures, materials, or acts set forth herein, and all of the equivalents thereof. Further, the structures, materials or acts and the equivalents thereof shall include all those described in the summary of the invention, brief description of the drawings, detailed description, abstract, and claims themselves.

The term "module" as used herein refers to any known or later developed hardware, software, firmware, artificial intelligence, fuzzy logic, or combination of hardware and software that is capable of performing the functionality associated with that element.

A "server" is a computational system (e.g., having both software and suitable computer hardware) to respond to requests across a computer network to provide, or assist in providing, a network service. Servers can be run on a dedicated computer, which is also often referred to as "the server", but many networked computers are capable of hosting servers. In many cases, a computer can provide several services and have several servers running. Servers commonly operate within a client-server architecture, in which servers are computer programs running to serve the requests of other programs, namely the clients. The clients typically connect to the server through the network but may run on the same computer. In the context of Internet Protocol (IP) networking, a server is often a program that operates as a socket listener. An alternative model, the peer-to-peer networking module, enables all computers to act as either a server or client, as needed. Servers often provide essential services across a network, either to private users inside a large organization or to public users via the Internet.

The term "social network" refers to a web-based social network maintained by a social network service. A social network is an online community of people, who share interests and/or activities or who are interested in exploring the interests and activities of others.

The term "sound" or "sounds" as used herein refers to vibrations (changes in pressure) that travel through a gas, liquid, or solid at various frequencies. Sound(s) can be measured as differences in pressure over time and include frequencies that are audible and inaudible to humans and other animals. Sound(s) may also be referred to as frequencies herein.

The preceding is a simplified summary of the disclosure to provide an understanding of some aspects of the disclosure. This summary is neither an extensive nor exhaustive overview of the disclosure and its various aspects, embodiments, and/or configurations. It is intended neither to identify key or critical elements of the disclosure nor to delineate the scope of the disclosure but to present selected concepts of the disclosure in a simplified form as an introduction to the more detailed description presented below. As will be appreciated, other aspects, embodiments, and/or configurations of the disclosure are possible utilizing, alone or in combination, one or more of the features set forth above or described in detail below. Also, while the disclosure is presented in terms of exemplary embodiments, it should be appreciated that individual aspects of the disclosure can be separately claimed.

DETAILED DESCRIPTION

The ensuing description provides embodiments only, and is not intended to limit the scope, applicability, or configuration of the claims. Rather, the ensuing description will provide those skilled in the art with an enabling description for implementing the embodiments. Various changes may be made in the function and arrangement of elements without departing from the spirit and scope of the disclosure.

Figure 1:
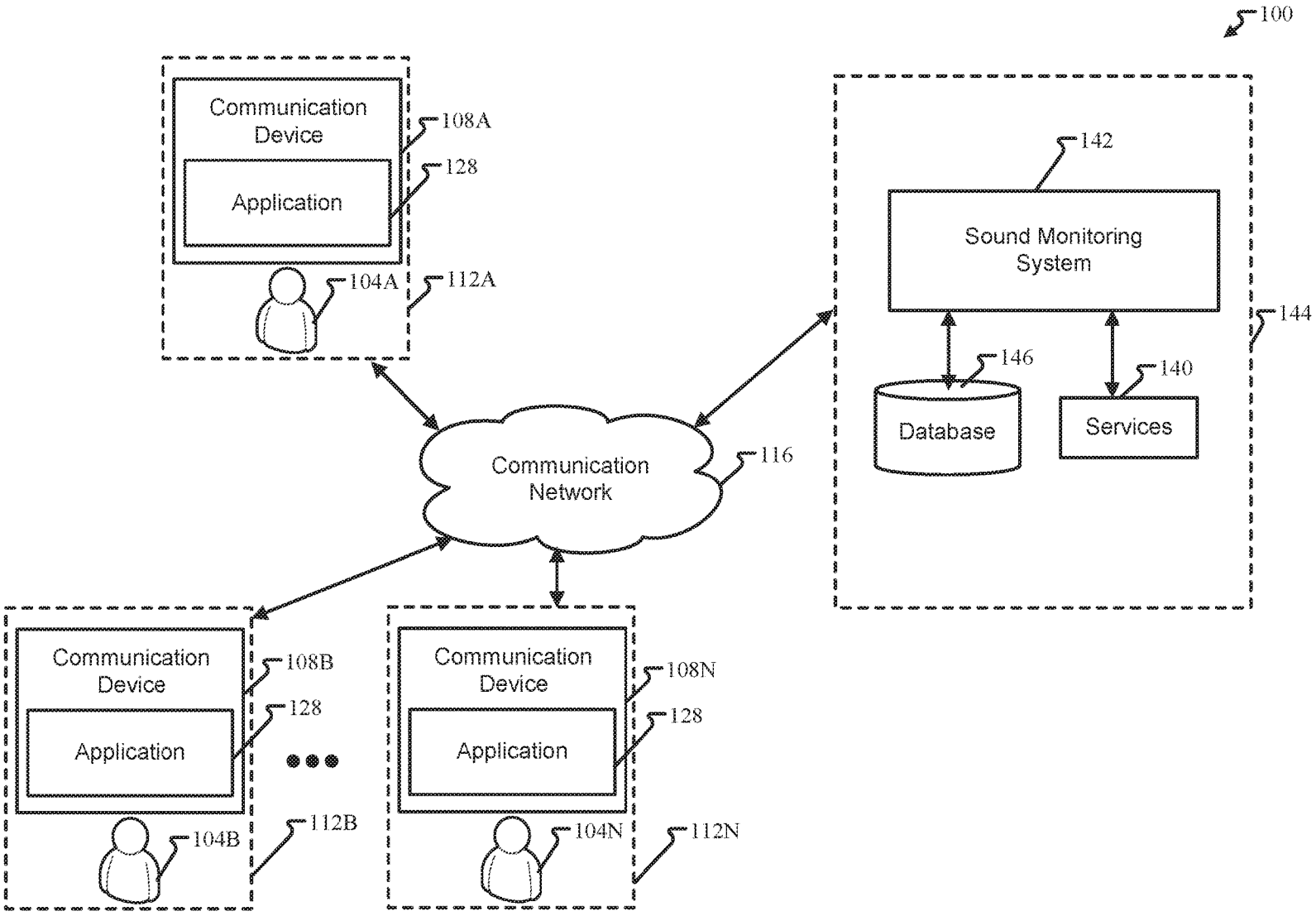
FIG. 1 illustrates a first block diagram of a communications system according to an embodiment of the disclosure.

Referring to FIG. 1, a communication system 100 is illustrated in accordance with at least one embodiment of the present disclosure. The communication system 100 may allow a user 104A to participate in the communication system 100 using a communication device 108A while in a location 112A. As used herein, communication devices include user devices. Other users 104B to 104N also can participate in the communication system 100 using respective communication devices 108B through 108N at various locations 112B through 112N, which may be the same as, or different from, location 112A. Although each of the users 104A-N are depicted as being in respective locations 112A-N, any of the users 104A-N may be at locations other than the locations specified in FIG. 1. In accordance with embodiments of the present disclosure, one or more of the users 104A-N may access a sound monitoring system 142 utilizing the communication network 116.

Although the details of only some communication devices 104A-N are depicted in FIG. 1, one skilled in the art will appreciate that some or all of the communication devices 104B-N may be equipped with different or identical components as the communication devices 104A-N depicted in FIG. 1.

The communication network 116 may be packet-switched and/or circuit-switched. An illustrative communication network 116 includes, without limitation, a Wide Area Network (WAN), such as the Internet, a Local Area Network (LAN), a Personal Area Network (PAN), a Public Switched Telephone Network (PSTN), a Plain Old Telephone Service (POTS) network, a cellular communications network, an IP Multimedia Subsystem (IMS) network, a Voice over IP (VoIP) network, a SIP network, or combinations thereof. The Internet is an example of the communication network 116 that constitutes an Internet Protocol (IP) network including many computers, computing networks, and other communication devices located all over the world, which are connected through many telephone systems and other means. In one configuration, the communication network 116 is a public network supporting the TCP/IP suite of protocols. Communications supported by the communication network 116 include real-time, near-real-time, and non-real-time communications. For instance, the communication network 116 may support voice, video, text, web-conferencing, or any combination of media. Moreover, the communication network 116 may comprise a number of different communication media such as coaxial cable, copper cable/wire, fiber-optic cable, antennas for transmitting/receiving wireless messages, and combinations thereof. In addition, it can be appreciated that the communication network 116 need not be limited to any one network type, and instead may be comprised of a number of different networks and/or network types. It should be appreciated that the communication network 116 may be distributed. Although embodiments of the present disclosure will refer to one communication network 116, it should be appreciated that the embodiments claimed herein are not so limited. For instance, more than one communication network 116 may be joined by combinations of servers and networks.

Each of the communication devices 108A-N may comprise any type of known communication equipment or collection of communication equipment. Examples of a suitable communication devices 108A-N may include, but are not limited to, a personal computer and/or laptop with a telephony application, a cellular phone, a smart phone, a telephone, a tablet, or other device that can make or receive communications. In general, each communication device 108A-N may provide many capabilities to one or more users 104A-N who desire to interact with the sound monitoring system 142. Although each user device 208A is depicted as being utilized by one user, one skilled in the art will appreciate that multiple users may share a single user device 208A. Capabilities enabling the disclosed systems and methods may be provided by one or more communication devices through hardware or software installed on the communication device, such as application 128. For example, the application 128 can monitor data received at the communication device by one or more sensors. The sensors can include a microphone or any other device that can detect changes in pressure over time. The sensors may be located at various locations, such as at communication devices 108A-N, or at locations 112A-N, or at other locations. Further description of application 128 is provided below.

In some embodiments, the sound monitoring system 142 may reside within a server 144. The server 144 may be a server that is administered by an enterprise associated with the administration of communication device(s) or owning communication device(s), or the server 144 may be an external server that can be administered by a third-party service, meaning that the entity which administers the external server is not the same entity that either owns or administers a user device. In some embodiments, an external server may be administered by the same enterprise that owns or administers a user device. As one particular example, a user device may be provided in an enterprise network and an external server may also be provided in the same enterprise network. As a possible implementation of this scenario, the external server may be configured as an adjunct to an enterprise firewall system, which may be contained in a gateway or Session Border Controller (SBC) which connects the enterprise network to a larger unsecured and untrusted communication network. An example of a messaging server is a unified messaging server that consolidates and manages multiple types, forms, or modalities of messages, such as voice mail, email, short-message-service text message, instant message, video call, and the like.

Although various modules and data structures for disclosed methods and systems are depicted as residing on the server 144, one skilled in the art can appreciate that one, some, or all of the depicted components of the server 144 may be provided by other software or hardware components. For example, one, some, or all of the depicted components of the server 144 may be provided by logic on a communication device (e.g., the communication device may include logic for the methods and systems disclosed herein so that the methods and systems are performed locally at the communication device). Further, the logic of application 128 can be provided on the server 144 (e.g., the server 144 may include logic for the methods and systems disclosed herein so that the methods and systems are performed at the server 144). In embodiments, the server 144 can perform the methods disclosed herein without use of logic on any communication devices 108A-N.

The sound monitoring system 142 implements functionality for the methods and systems described herein by interacting with one or more of the communication devices 108A-N, application 128, database 146, and services 140, and/or other sources of information not shown (e.g., data from other servers or databases, and/or from a presence server containing historical or current location information for users and/or communication devices). In various embodiments, settings (including alerts and thresholds, and settings relating to recordings) may be configured and changed by any users and/or administrators of the system 100. Settings may be configured to be personalized for a device or user, and may be referred to as profile settings.

For example, the sound monitoring system 142 can optionally interact with a presence server that is a network service which accepts, stores and distributes presence information. Presence information is a status indicator that conveys an ability and willingness of a user to communicate. User devices can provide presence information (e.g., presence state) via a network connection to a presence server, which can be stored in what constitutes a personal availability record (e.g., a presentity) and can be published and/or made available for distribution. Use of a presence server may be advantageous, for example, if a sound requiring a notification is occurring at a specific location that is frequented by a user; however the user is not at the location at the time the sound is detected. In such a circumstance, the system may send a notification to a user of the sound so that the user may avoid the location if desired. In addition, settings of the sound monitoring system 142 may be customizable based on an indication of availability information and/or location information for one or more users.

The database 146 may include information pertaining to one or more of the users 104A-N, communication devices 108A-N, and sound monitoring system 142, among other information. For example, the database 146 can include settings for notifying users of sounds that are detected, including settings related to alerts, thresholds, recordings, locations (including presence information) communication devices, users, and applications.

The services module 140 may allow access to information in the database 146 and may collect information from other sources for use by the sound monitoring system 142. In some instances, data in the database 146 may be accessed utilizing one or more service modules 140 and an application 128 running on one or more communication devices, such as communication devices 108A-N, at any location, such as locations 112A-N. Although FIG. 1 depicts a single database 146 and a single service module 140, it should be appreciated that one or more servers 144 may include one or more services module 140 and one or more databases 146.

Application 128 may be executed by one or more communication devices (e.g., communication devices 108A-N) and may execute all or part of sound monitoring system 142 at one or more of the communication device(s) by accessing data in database 146 using service module 140. Accordingly, a user may utilize the application 128 to access and/or provide data to the database 146. For example, a user 104A may utilize application 128 executing on communication device 108A to invoke alert settings using thresholds of frequencies that the user 104A wishes to receive an alert for if frequencies exceeding such thresholds are detected at the communication device 108A. Such data may be received a t the sound monitoring system 142 and associated with one or more profiles associated with the user 104A and stored in database 146. Alternatively, or in addition, the sound monitoring system 142 may receive an indication that other settings associated with various criteria should be applied in specified circumstances. For example, settings may be associated with a particular location (e.g., location 112A) so that the settings are applied to user 104A's communication device 108A based on the location (e.g., from an enterprise associated with user 104A). Thus, data associated with a profile of user 104A and/or a profile of location 112A may be stored in the database 146 and used by application 128.

Notification settings and/or recording settings may be set based on any criteria. In some aspects, different types of thresholds may be used to configure notifications and/or recordings. For example, the thresholds may correspond to one or more specified frequencies, or a detection of a specified range of frequencies occurring over time. In embodiments described herein, notification settings can including settings for recordings. Settings, including data regarding thresholds, notifications and recordings, may be stored at any location. The settings may be predetermined (e.g., automatically applied upon use of the application 128) and/or set or changed based on various criteria. The settings are configurable for any timing or in real-time (e.g., the monitoring may occur at any timing or continuously in real-time).

Settings can include customized settings for any user, device, or groups of users or devices, for example. For example, users may each have profile settings that configure their thresholds, alerts, and/or recordings, among other user preferences. In various embodiments, settings configured by a user may be referred to as user preferences, alarm preferences, and user profile settings. Settings chosen by an administrator or certain user may override other settings that have been set by other users, or settings that are set to be default to a device or location, or any other settings that are in place. Alternatively, settings chosen by a receiving user may be altered or ignored based on any criteria at any point in the process. For example, settings may be created or altered based on a user's association with a position, a membership, or a group, based on a location or time of day, or based on a user's identity or group membership, among others.

The settings of the application 128 can cause a notification/alert to be displayed at communication device 108A when a sound outside of a frequency range or threshold is detected. Frequencies used by the settings may be set based on a specific frequency, or a frequency range(s). Upper or lower limits on a frequency or range(s) of frequencies may be referred to as thresholds herein. One or more frequencies may be configured to have a notification sent to a user (via one or more devices) when the frequency or frequencies are detected, and these may be set to be the same or different for one or more locations, one or more devices, and/or one or more people, for example. Thus, one or more thresholds may be set for any user, communication device, and/or location. In addition, application 128 may automatically configure one or more communication devices 108A-N with thresholds and/or notifications. The thresholds and/or notifications may vary based on a user's preferences (including preferences regarding specific communication devices), properties associated with a user, properties associated with devices, locations associated with devices or users, and groups that a user is a member of, among others. In various embodiments, one or more thresholds and/or notifications may be set based upon a possibility of harm to humans at the frequency range(s) being detected.

As some non-limiting examples, detection of a frequency that indicates the occurrence of cross-device tracking by a microphone on communication device 108A at location 112A may trigger an emailed alert to an account accessed at communication device 108A. However, detection of a frequency associated with harm to humans by a microphone on communication device 108A at location 112A may trigger audio, visual, and haptic alerts to all communication devices, including communication device 108A, located at location 112A, as well as visual alerts to any communication devices located within a specified distance from location 112A (e.g., communication device 108N at location 112N if location 112N is within the specified distance from location 112A), as well as visual alerts to any communication devices having a user with a home or work location that is within a specified distance from location 112A (e.g., the visual alert would occur at communication device 108B at location 112B if user B 104B has a work or home location that is within the specified distance from location 112A, even if location 112B is not within the specified distance from location 112A). Further, the settings can specify that a communication device that is outside of a location where the harmful frequency is being detected, but still associated with the location (e.g., a location visited by a user of the communication device), will display a reduced alert (e.g., a visual alert instead of an audible, visual, and haptic alert) if the communication device is not at the location where the harmful frequency is detected. Notifications may be configured in any manner, including to one or more devices and at any timing, including being sent at varying times or simultaneously. Thus, the methods and systems described herein can monitor various frequencies of sounds and enact various notifications based on the frequencies detected.

Audible alerts can include any type of audible indication of the notification that may be any type of sound and any volume of sound. Visual alerts can include a visual indication of the notification, such as words on the device, a symbol appearing on the device, a flashing or solid lit LED, etc. Haptic alerts can include any type of haptic indication of the notification. The notifications may occur based on any criteria.

As can be appreciated by one skilled in the art, functions offered by the elements depicted in FIG. 1 may be implemented in one or more network devices (i.e., servers, networked user device, non-networked user device, etc.).

Figure 2:
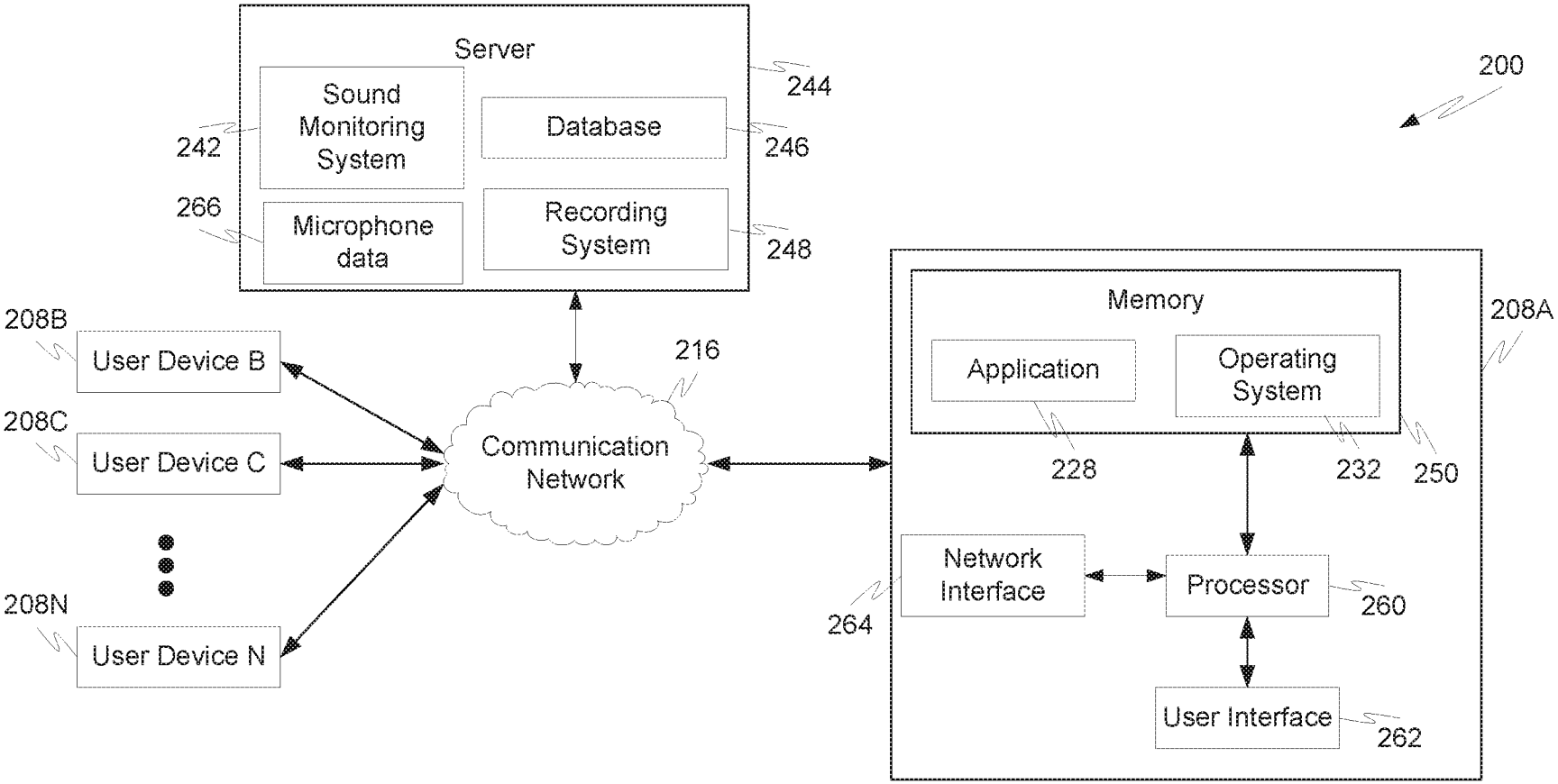
FIG. 2 illustrates a second block diagram of a communications system according to an embodiment of the disclosure.

Referring to FIG. 2, a communication system 200 is illustrated in accordance with at least one embodiment of the present disclosure. A communication system 200 includes user device 208A that is configured to interact with other user devices 208B through 208N via a communication network 216, as well as interact with a server 244 via the communication network 216. The depicted user device 208A includes a processor 260, memory 250, a user interface 262, and a network interface 264. The memory 250 includes application 228 and operating system 232. Although the details of only one user device 208A are depicted in FIG. 2, one skilled in the art will appreciate that some or all of the other user devices 204B-N may be equipped with different, similar, or identical components as the user device 208A depicted in detail. Server 244 has sound monitoring system 242, database 246, services 240, recording system 248, and microphone data 266. In some aspects, the components shown in FIG. 2 may correspond to like components shown in FIG. 1.

The user interface 262 may include one or more user input and/or one or more user output device. The user interface 262 can enable a user or multiple users to interact with the user device 208A. Exemplary user input devices which may be included in the user interface 262 comprise, without limitation, a microphone, a button, a mouse, trackball, rollerball, or any other known type of user input device. Exemplary user output devices which may be included in the user interface 262 comprise, without limitation, a speaker, light, Light Emitting Diode (LED), display screen, buzzer, or any other known type of user output device. In some embodiments, the user interface 262 includes a combined user input and user output device, such as a touch-screen.

The processor 260 may include a microprocessor, Central Processing Unit (CPU), a collection of processing units capable of performing serial or parallel data processing functions, and the like.

The memory 250 may include a number of applications or executable instructions that are readable and executable by the processor 260. For example, the memory 250 may include instructions in the form of one or more modules and/or applications. The memory 250 may also include data and rules in the form of one or more settings for thresholds and/or alerts that can be used by one or more of the modules and/or applications described herein. Exemplary applications include an operating system 232 and application 228.

The operating system 232 is a high-level application which enables the various other applications and modules to interface with the hardware components (e.g., processor 260, network interface 264, and user interface 262) of the user device 208A. The operating system 232 also enables a user or users of the user device 208A to view and access applications and modules in memory 250 as well as any data, including settings.

The application 228 may enable other applications and modules to interface with hardware components of the user device 208A. Exemplary features offered by the application 228 include, without limitation, monitoring features (e.g., sound monitoring from microphone data acquired locally or remotely such as microphone data 266), notification/alerting features (e.g., the ability to configures settings and manage various audio, visual, and/or haptic notifications), recording features (e.g., voice communication applications, text communication applications, video communication applications, multimedia communication applications, etc.), and so on. In some embodiments, the application 228 includes the ability to facilitate real-time monitoring and/or notifications across the communication network 216.

The memory 250 may also include a sound monitoring module, instead of one or more applications 228, which provides some or all functionality of the sound monitoring and alerting as described herein, and the sound monitoring system 342 can interact with other components to perform the functionality of the monitoring and alerting, as described herein. In particular, the sound monitoring module may contain the functionality necessary to enable the user device 208A to monitor sounds and provide notifications.

Although some applications and modules are depicted as software instructions residing in memory 250 and those instructions are executable by the processor 260, one skilled in the art will appreciate that the applications and modules may be implemented partially or totally as hardware or firmware. For example, an Application Specific Integrated Circuit (ASIC) may be utilized to implement some or all of the functionality discussed herein.

Although various modules and data structures for disclosed methods and systems are depicted as residing on the user device 208A, one skilled in the art can appreciate that one, some, or all of the depicted components of the user device 104A may be provided by other software or hardware components. For example, one, some, or all of the depicted components of the user device 208A may be provided by a sound monitoring system 242 which is operating on a server 244. Further, the logic of server 244 can be provided on the user device(s) 208A-N (e.g., one or more of the user device(s) 208A-N may include logic for the methods and systems disclosed herein so that the methods and systems are performed at the user device(s) 208A-N). In embodiments, the user device(s) 208A-N can perform the methods disclosed herein without use of logic on the server 244.

The memory 250 may also include one or more communication applications and/or modules, which provide communication functionality of the user device 208A. In particular, the communication application(s) and/or module(s) may contain the functionality necessary to enable the user device 208A to communicate with other user devices 208B and 208 C through 208N across the communication network 116. As such, the communication application(s) and/or module(s) may have the ability to access communication preferences and other settings, maintained within a locally-stored or remotely-stored profile (e.g., one or more profiles maintained in database 246 and/or memory 250), format communication packets for transmission via the network interface 264, as well as condition communication packets received at a network interface 264 for further processing by the processor 260. For example, locally-stored communication preferences may be stored at a user device 208A-N. Remotely-stored communication preferences may be stored at a server, such as server 244. Communication preferences may include settings information and alert information, among other preferences.

The network interface 264 comprises components for connecting the user device 208A to communication network 216. In some embodiments, a single network interface 264 connects the user device to multiple networks. In some embodiments, a single network interface 264 connects the user device 208A to one network and an alternative network interface is provided to connect the user device 208A to another network. The network interface 264 may comprise a communication modem, a communication port, or any other type of device adapted to condition packets for transmission across a communication network 216 to one or more destination user devices 208B-N, as well as condition received packets for processing by the processor 260. Examples of network interfaces include, without limitation, a network interface card, a wireless transceiver, a modem, a wired telephony port, a serial or parallel data port, a radio frequency broadcast transceiver, a USB port, or other wired or wireless communication network interfaces.

The type of network interface 264 utilized may vary according to the type of network which the user device 208A is connected, if at all. Exemplary communication networks 216 to which the user device 208A may connect via the network interface 264 include any type and any number of communication mediums and devices which are capable of supporting communication events (also referred to as "messages," "communications" and "communication sessions" herein), such as voice calls, video calls, chats, emails, TTY calls, multimedia sessions, or the like. In situations where the communication network 216 is composed of multiple networks, each of the multiple networks may be provided and maintained by different network service providers. Alternatively, two or more of the multiple networks in the communication network 216 may be provided and maintained by a common network service provider or a common enterprise in the case of a distributed enterprise network.

In embodiments shown in FIG. 2, the sound monitoring system 242 implements functionality for the methods and systems described herein by interacting with one or more of the communication devices 208A-N, application 228, database 246, services 240, recording system 248, microphone data 266, and/or other sources of information not shown. The sound monitoring system 242 may interact with the application 228 to provide the methods and systems described herein. For example, the sound monitoring system 242 may determine a user's settings, or settings preferences, by accessing the application 228. Also, the sound monitoring system 242 can provide notifications to a user via the application 228.

Data used or generated by the methods and systems described herein may be stored at any location. In some embodiments, data (including settings) may be stored by an enterprise and pushed to the user device 208A on an as-needed basis. The remote storage of the data may occur on another user device or on a server. In some embodiments, a portion of the data are stored locally on the user device 208A and another portion of the data are stored at an enterprise and provided on an as-needed basis.

In various embodiments, microphone data 266 may be received and stored at the server. Although FIG. 2 shows microphone data 266 stored on the server 244, the microphone data 266 may be stored in other locations, such as directly on a user device. The microphone data 266 can include sound data received from various sources, such as from one or more user devices 208A-N, from other devices able to monitor (e.g., detect) sounds, and from other servers, for example. In various embodiments, microphone data 266 is sound received and monitored (e.g., processed) in real-time so that data storage requirements are minimal.

In certain aspects of the present disclosure, the sound monitoring system 242 monitors microphone data 266 to determine if notifications should be sent to any of the user devices 208A-N. For example, the microphone data 266 may be received from user device 208A and the sound monitoring system 242 may determine that a frequency within the microphone data 266 is outside of a threshold set by the system as being dangerous to humans. The sound monitoring system 242 may process the microphone data 266 using the settings stored in database 246. After determining that the threshold has been exceeded, the sound monitoring system 242 can send a notification to display on user device 208A via communication network 216, network interface 264, application 228, processor 260, and user interface 262.

The recording system 248 may be configured to record some or all of the microphone data 266 according to various settings. For example, the recording system 248 may be triggered to record when the sound monitoring system 242 detects that frequency within the microphone data 266 is outside of a threshold set by the system as being dangerous to humans. The recording system 248 may continue to record until the sound data returns to an acceptable frequency level (e.g., is within the threshold set).

Although various modules and data structures for disclosed methods and systems are depicted as residing on the user device 208A, one skilled in the art can appreciate that one, some, or all of the depicted components of the user device 208A may be provided by a sound monitoring system 242 which is operating on an external server 244. In some embodiments, the external server 244 is administered by a third-party service meaning that the entity which administers the server 244 is not the same entity that either owns or administers the user device 208A. In some embodiments, the server 244 may be administered by the same enterprise that owns or administers the user device 208A. As one particular example, the user device 208A may be provided in an enterprise network and the server 244 may also be provided in the same enterprise network. As one possible implementation of this scenario, the server 244 may be configured as an adjunct to an enterprise firewall system which may be contained in a gateway or Session Border Controller (SBC) which connects the enterprise network to a larger unsecured and untrusted communication network 216.

As can be appreciated by one skilled in the art, functions offered by the modules depicted in FIG. 2 may be implemented in one or more network devices (i.e., servers, networked user device, non-networked user device, etc.).

Figure 3:
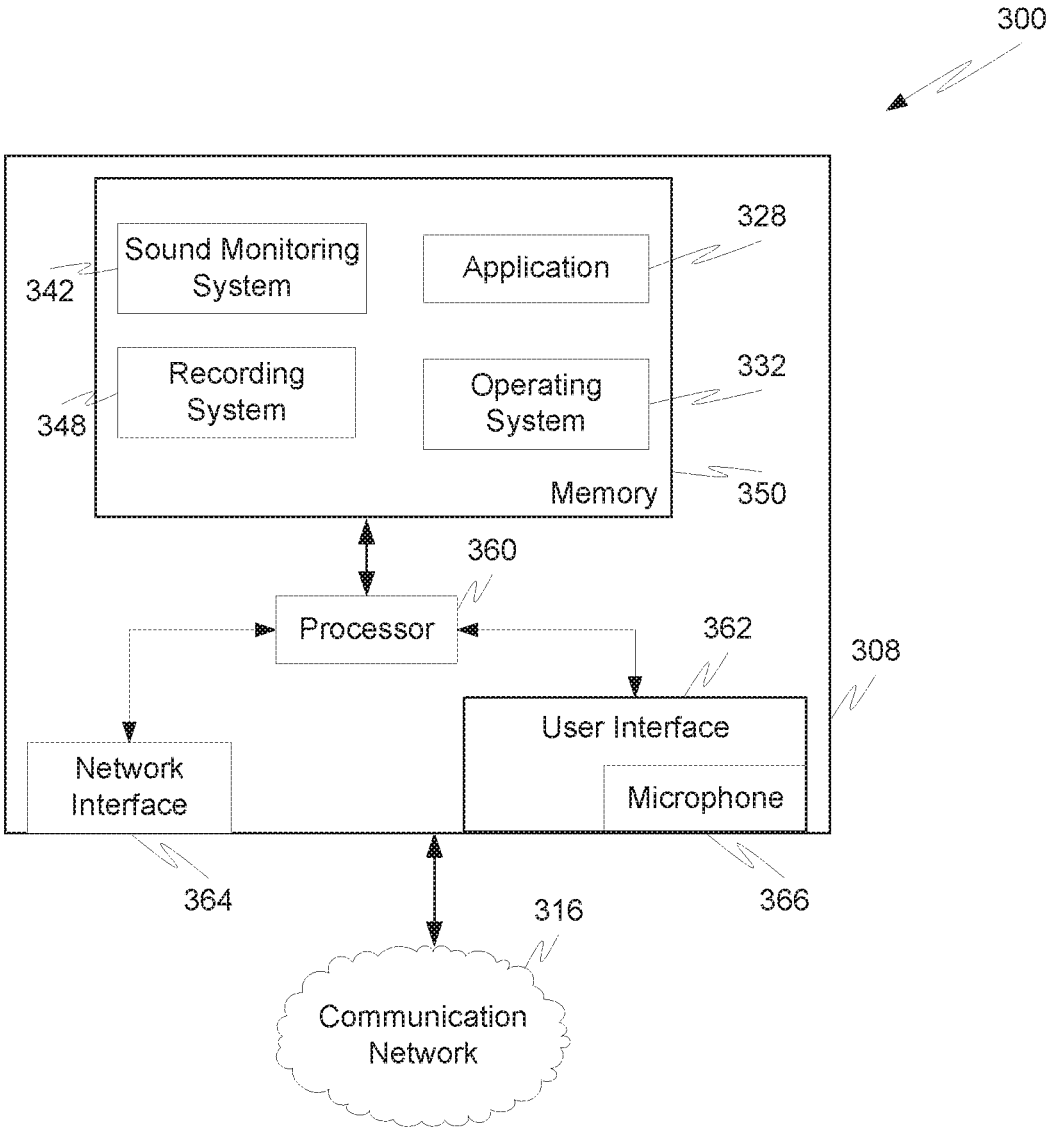
FIG. 3 illustrates a third block diagram of a communications system according to an embodiment of the disclosure.

A communication system 300 including a user device 308 capable of allowing a user to interact with other user devices via a communication network 316 is shown in FIG. 3. The depicted user device 308 includes a processor 360, memory 350, a user interface 362, a network interface 364, and a microphone 366. The memory 350 includes a sound monitoring system 342, a recording system 348, an application 328, and an operating system 332. Although the details of only one user device 308 are depicted in FIG. 3, one skilled in the art will appreciate that one or more other user devices may be equipped with similar or identical components as the user device 308 depicted in detail. Components shown in FIG. 3 may correspond to those shown and described in FIGS. 1 and 2.

The user interface 362 can enable a user or multiple users to interact with the user device 308A and includes microphone 366. Exemplary user input devices which may be included in the user interface 362 comprise, without limitation, a button, a mouse, trackball, rollerball, image capturing device, or any other known type of user input device. Exemplary user output devices which may be included in the user interface 362 comprise, without limitation, a speaker, light, Light Emitting Diode (LED), display screen, buzzer, or any other known type of user output device. In some embodiments, the user interface 362 includes a combined user input and user output device, such as a touch-screen. Using user interface 362, a user may configure settings via the application 328 for thresholds and notifications of the sounds monitoring system 342.

The processor 360 may include a microprocessor, Central Processing Unit (CPU), a collection of processing units capable of performing serial or parallel data processing functions, and the like. The processor 360 interacts with the memory 312, user interface 362, and network interface 364 and may perform various functions of the application 328 and sound monitoring system 342.

The memory 350 may include a number of applications or executable instructions that are readable and executable by the processor 360. For example, the memory 350 may include instructions in the form of one or more modules and/or applications. The memory 250 may also include data and rules in the form of one or more settings for thresholds and/or alerts that can be used by the application 328, the sound monitoring module 342, and the processor 360.

The operating system 332 is a high-level application which enables the various other applications and modules to interface with the hardware components (e.g., processor 360, network interface 364, and user interface 362, including microphone 366) of the user device 308. The operating system 332 also enables a user or users of the user device 308 to view and access applications and modules in memory 350 as well as any data, including settings. In addition, the application 328 may enable other applications and modules to interface with hardware components of the user device 308.

The memory 350 may also include a sound monitoring module 342, instead of or in addition to one or more applications, including application 328. The sound monitoring module 342 and the application 328 provide some or all functionality of the sound monitoring and notifying as described herein, and the sound monitoring system 342 and application 328 can interact with other components to perform the functionality of the monitoring and notifying, as described herein. In particular, the sound monitoring module 342 may contain the functionality necessary to enable the user device 308 to monitor sounds and provide notifications.

Although some applications and modules are depicted as software instructions residing in memory 350 and those instructions are executable by the processor 360, one skilled in the art will appreciate that the applications and modules may be implemented partially or totally as hardware or firmware. For example, an Application Specific Integrated Circuit (ASIC) may be utilized to implement some or all of the functionality discussed herein.

Although various modules and data structures for disclosed methods and systems are depicted as residing on the user device 308, one skilled in the art can appreciate that one, some, or all of the depicted components of the user device 308 may be provided by other software or hardware components. For example, one, some, or all of the depicted components of the user device 308 may be provided by systems operating on a server. In the illustrative embodiments shown in FIG. 3, the user device 308 includes all the necessary logic for the methods and systems disclosed herein so that the methods and systems are performed at the user device 308. Thus, the user device 308 can perform the methods disclosed herein without use of logic on a server.

In various embodiments, the user device 308 monitors sounds by receiving sounds in real-time through the microphone 366. The processor 360 monitors the sounds received by microphone 366 by measuring the frequencies of the sounds received and comparing the frequencies to thresholds stored in memory 312 and maintained by the sound monitoring system 342. If the processor 360 determines that a frequency received from the microphone 366 exceeds a threshold, the sound monitoring system 342 provides an alert at the user device 308, e.g., via the application 328 and the user interface 362.

Figure 4:
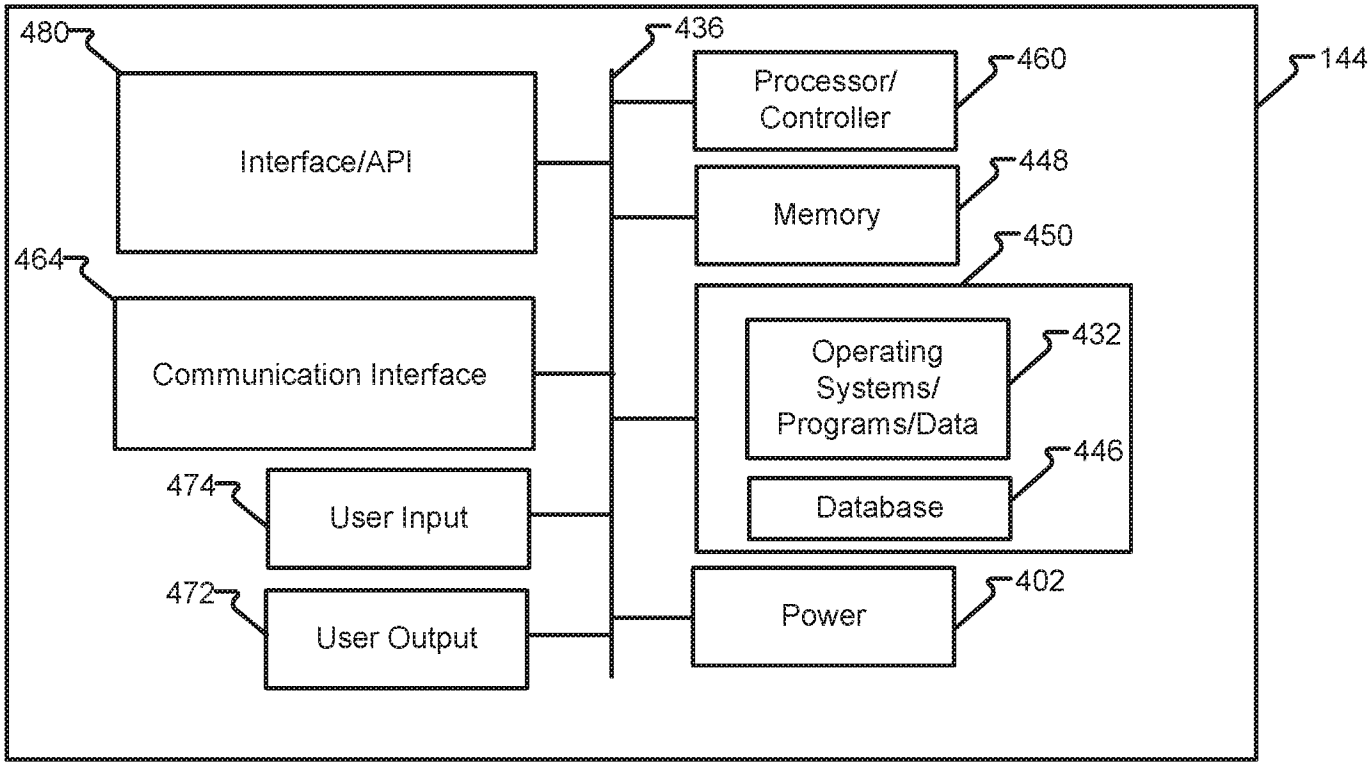
FIG. 4 illustrates a block diagram of a server in accordance with embodiments of the present disclosure.

With reference now to FIG. 4, this figure depicts additional details of one or more servers 144 implementing the sound monitoring system (e.g., sound monitoring system 142, 242, and 342, as shown in FIGS. 1-3, respectively) in accordance with embodiments of the present disclosure. Components shown in FIG. 4 may correspond to those shown and described in FIGS. 1, 2, and 3. The description of FIG. 4 below refers to various components of FIG. 1 by way of example.

The server 144 may include a processor/controller 460 capable of executing program instructions, which may include any general-purpose programmable processor or controller for executing application programming. Alternatively, or in addition, the processor/controller 460 may comprise an application specific integrated circuit (ASIC). The processor/controller 460 generally functions to execute programming code that implements various functions performed by the server 144. The processor/controller 460 also generally functions to execute programming code that implements various functions performed by systems and applications not located on the server (e.g., located on another server or on a user device), such as the sound monitoring system 142 and application 128. The processor/controller 460 may operate to execute one or more computer-executable instructions of the sound monitoring system 142 as is described herein. Alternatively, or in addition, the processor/controller 460 may operate to execute one or more computer-executable instructions of the services 140 and/or one or more functions associated with the data and database 146/446.

The server 144 additionally includes memory 448. The memory 448 may be used in connection with the execution of programming instructions by the processor/controller 460, and for the temporary or long-term storage of data and/or program instructions. For example, the processor/controller 460, in conjunction with the memory 448 of the server 144, may implement one or more modules, web services, APIs and other functionality that is needed and accessed by a communication device, such as communication device 108A. The memory 448 of the server 144 may comprise solid-state memory that is resident, removable, and/or remote in nature, such as DRAM and SDRAM. Moreover, the memory 448 may include a plurality of discrete components of different types and/or a plurality of logical partitions. In accordance with still other embodiments, the memory comprises a non-transitory computer-readable storage medium. Such a medium may take many forms, including, but not limited to, non-volatile media, volatile media, and transmission media.

The server 144 may include storage 450 for storing an operating system, one or more programs, and additional data 432. The storage 450 may be the same as or different from the memory 448. For example, the storage 450 of the server 144 may include a database 446 for storing data. Of course, the database 446 may be distributed across one or more servers 144.

In addition, user input devices 474 and user output devices 472 may be provided and used in connection with the server 144. Users may interact with the server 144 and/or sound monitoring system 142 in various way, and the methods and systems to interact are not limited by this disclosure. For example, a user may interact with the sound monitoring system 142, by interacting with a mobile application, such as application 128. Otherwise, a user may interact with the server 144 using user input devices 474 and user output devices 472. Examples of user input devices 474 include a keyboard, a numeric keypad, a touch screen, a microphone, scanner, and pointing device combined with a screen or other position encoder. Examples of user output devices 472 include a display, a touch screen display, a speaker, and a printer. Further, user output devices may provide one or more interfaces for user interfacing.

The server 144 generally includes a communication interface 464 to allow for communication between communication devices, such as communication devices 108A-N, and the sound monitoring system 142. The communication interface 464 may support 3G, 4G, cellular, WiFi, Bluetooth®, NFC, RS232, RF, Ethernet, one or more communication protocols, and the like. In some instances, the communication interface 464 may be connected to one or more mediums for accessing the communication network 116.

The server 144 may include an interface/API 480. Such interface/API 480 may include the necessary functionality to implement the sound monitoring system 142 or a portion thereof. Alternatively, or in addition, the interface/API 480 may include the necessary functionality to implement one or more services and/or one or more functions related to the data. Alternatively, or in addition, the interface/API 480 may include the necessary functionality to implement one or more of additional applications (not shown), including third party applications (not shown) and/or any portions thereof. Communications between various components of the server 144 may be carried out by one or more buses 436. Moreover, power 402 can be supplied to the components of the server 144. The power 402 may, for example, include a battery, an AC to DC converter, power control logic, and/or ports for interconnecting the server 144 to an external source of power.

Figure 5:
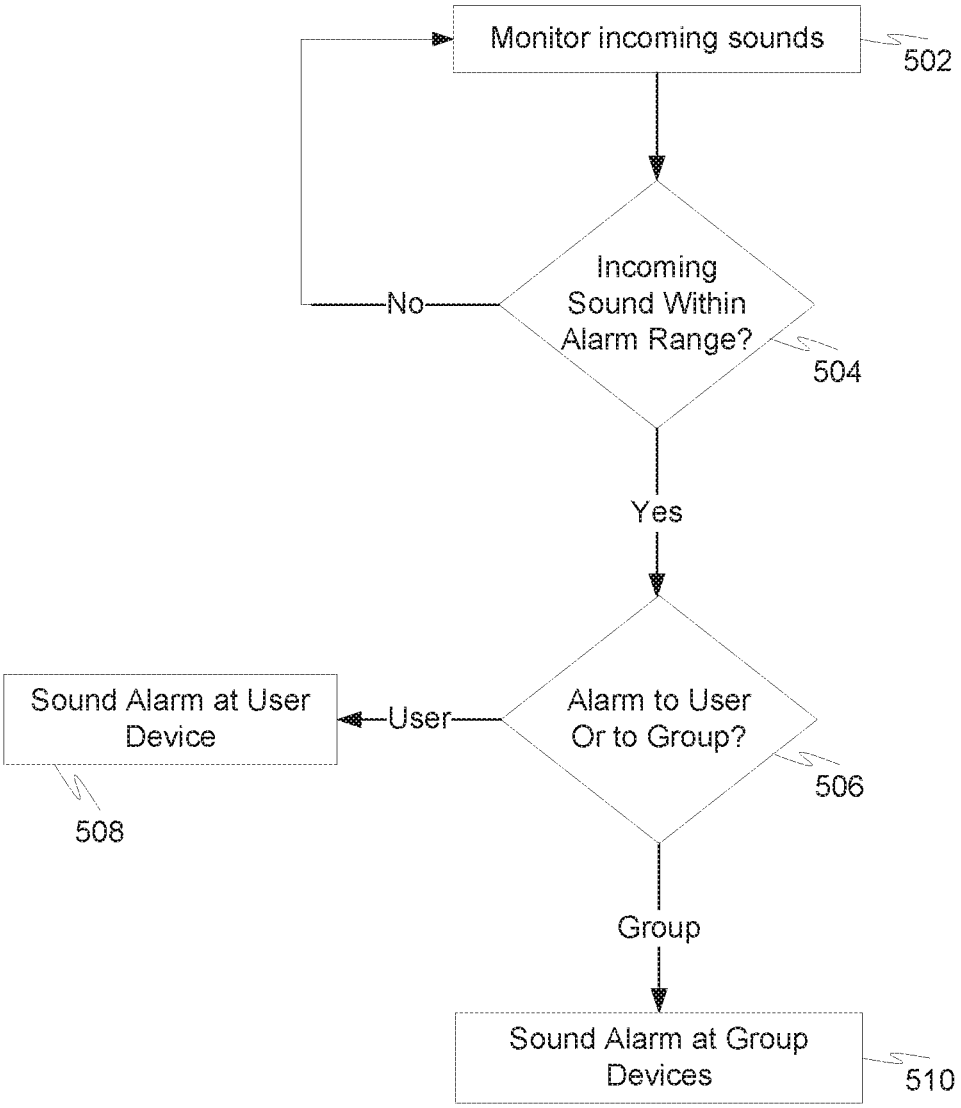
FIG. 5 is a first logic flow chart according to embodiments of the disclosure.

With reference now to FIG. 5, an exemplary logic flow chart will be described in accordance with at least some embodiments of the present invention. The method is initiated when incoming sounds are monitored at step 502. As discussed herein, the monitoring may be done at one or more devices (using a microphone or other method of detecting sound frequencies) and at any location. The monitoring may be continuous, in response to a user input at a device, and/or based on any criteria such as a known occupancy at the location. As discussed herein, the monitoring may occur at only one device or location, or multiple devices and/or locations.

During the monitoring, incoming sounds are received and processed (e.g., compared to thresholds of acceptable frequencies or other settings). Thresholds may be set based on any criteria, and multiple thresholds may be set with different actions taken at different thresholds, or the same actions taken at different thresholds. For example, a first threshold may be set at 20 Hz, and a second threshold may be set at 15 Hz. A notification for the first threshold may include a text notification that a sound frequency has been detected that is at 20 Hz. For the second threshold, either a same type of notification may be created (e.g., a text notification that a sound frequency has been detected that is at 15 Hz) or a different type of notification may be created such as an audible and visual alert that shows and sounds to notify of the sound frequency that has been detected that is at 15 Hz. Additional notifications may be created based on other variables, such as a timing of the frequency detected (e.g., whether it is at a certain time of day), and/or if the sound occurs over a specified period of time (e.g., if the sound is continuous for a certain amount of time or reaches a certain level a specified number of times over a specified amount of time). Such thresholds may be pre-set (e.g., pre-determined), or may change based on any criteria. The received sounds may be compared with thresholds for sound frequencies at step 504 to determine if the incoming sounds are within a notification range (e.g., the incoming sound wavelengths are at or above an upper threshold, or at or below a lower threshold), for example. In certain aspects, alarms may be configured to change in volume or brightness depending on levels of frequencies detected, and a chance of harm occurring from the frequencies detected. In some aspects, notifications of frequencies occurring that are not harmful to humans may be referred to as non-essential notifications.

If the incoming sounds are not within a notification/alarm range, then the monitoring of the incoming sounds continues in step 502. If the incoming sounds are within a notification/alarm range, then an alarm is sent to a user or to a group of users in step 506. In step 506, the alarm can be sent to one or more users based on any criteria, such as group membership or device or user location(s). For example, if the frequency range(s) of the monitored sounds are within one range of thresholds (e.g., between an upper threshold and a lower threshold), the alarm may be sent to only one user's device; however, if the frequency range(s) of the monitored sounds are within another threshold (e.g., below the lower threshold), the alarm may be sent to multiple users' devices. If it is determined that the alarm is to be sent to one user, the method proceeds to send an alarm to one or more devices associated with the user in step 508. If it is determined that the alarm is to be sent to a group of users, then the alarm is sent to devices associated with members of the group in step 510. The group may have a membership that is based on any criteria; for example, the group may include members that have devices at a specified location or within a specified distance from the device that detected the incoming sound that triggered the threshold.

Alarms and notifications as used herein include any alarms and/or notifications that may be sent to various devices in any manner and configuration. For example, although methods and systems described herein use the term "sound," the notifications/alarms at device(s) may take any form, such as using haptic feedback, LED feedback, etc. As described herein, the notifications/alarms are customizable by users and administrators or may be pre-set by the system.

Figure 6:
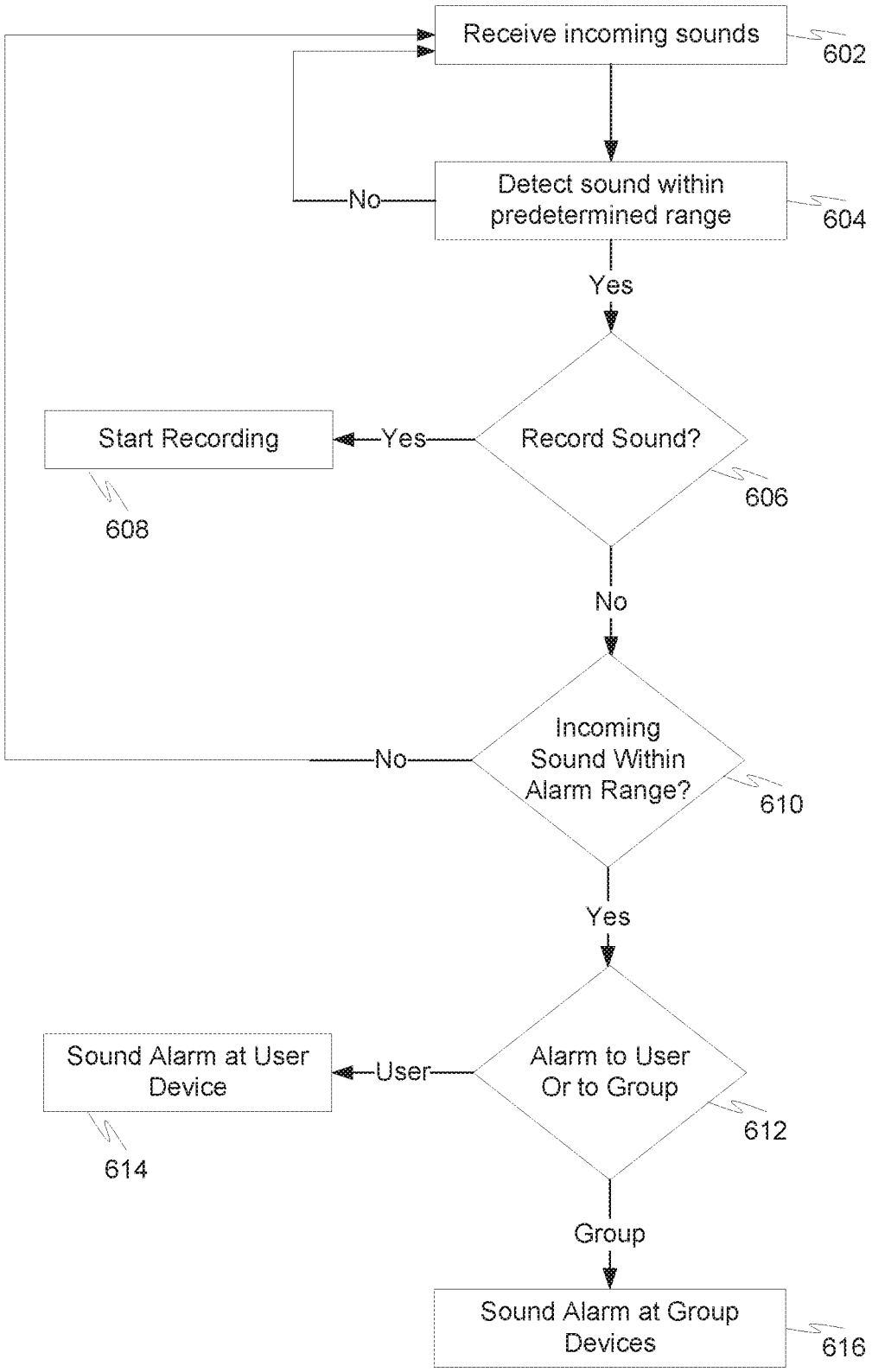
FIG. 6 is a second logic flow chart according to embodiments of the disclosure.

With reference now to FIG. 6, an exemplary logic flow chart will be described in accordance with at least some embodiments of the present invention. The method is initiated when incoming sounds are monitored by receiving the sounds at step 602. As discussed herein, the monitoring may be configured based on any criteria and is not limited by the present disclosure.

During the monitoring, incoming sounds are received and processed. For example, monitored sounds may be compared with pre-determined thresholds or threshold ranges of sound wavelengths at step 604 to determine if the incoming sounds are within an alarm range (e.g., the incoming sound wavelengths are at or above an upper threshold, or at or below a lower threshold). In various embodiments, the thresholds may be configured based upon a possibility of harm to humans at the frequency range(s) being detected. In further embodiments, the thresholds may be configured based upon an inability for a user to hear certain sounds. The system may access locally stored or remotely stored data containing the settings for the alerts and/or thresholds to implement the methods and systems described herein.

To determine the thresholds and other settings (e.g., settings for recording, types of alarm(s) to be sent and users to send the alarm(s) to), locally or remotely stored settings may be accessed. In various embodiments, users may save profile settings that configure the system for the user's preferences. The system (e.g., a sound monitoring system or an application as described herein) may check remote or local data to determine if the alert preferences for a user are locally available. If the desired information is not locally available, then the system may request such data from a user's user device or from any other known source of such information. If such information cannot be obtained, then the system may assume an alert preference for the user based on various factors, including one or more of (i) the location of the user; (ii) the location of the user device being utilized by the user; (iii) presence information of the user (i.e., whether the user is logged into any communication service and, if so, whether alert preferences for that user are obtainable from the communication service); and the like.

If the incoming sounds are not within a predetermined range, then the monitoring of the incoming sounds continues in step 602. If the incoming sounds are within a predetermined range, then the method proceeds to determine if the monitored sounds should be recorded in step 606. Determining whether a recording should be started may be based on any criteria, such as settings of the system or settings that have been configured by a user or administrator. Also, a recording may be started based on a threshold that the monitored sound has met or exceeded.

If the sound is to be recorded, the recording is started in step 608. For example, the sound can be recorded automatically (e.g., based on various settings, or so that it can be saved for later analysis, or so that it can be saved to be transcribed for a hearing impaired user, among other reasons), or based on thresholds related to the range(s) of the sounds detected, and/or based on a location of the sound. The recorded data may be saved to any one or more locations, such as a database on a server or a user device. The recording may stop at a certain time, or after a specified amount of time has passed, or it may continue until a user or administrator stops it. If the sound it not to be recorded, then the method proceeds to step 610.

In step 610, the incoming sound is processed to determine if it is within an alarm range. If the incoming sound is not within an alarm range, then the monitoring of the incoming sounds continues in step 602. If the incoming sounds are within an alarm range, then the method proceeds to step 612.

In step 612, a decision is made regarding whether to send an alarm to a user or to a group. As discussed herein, one or more alarm(s) can be sent to one or more users based on any criteria. If it is determined the alarm is to be sent to one user, the method proceeds to sound an alarm at a user device in step 614. If it is determined that the alarm is to be sent to a group, the alarm is sent to sound at group devices in step 616. The alarm may be sent to various devices in any manner and configuration. For example, different devices and/or different users may have different types of alarms that occur (e.g., an audible and visual alarm for a mobile device but only an audible and visual alarm for a laptop computer, or an audible and visual alarm for a supervisor at a facility but only a visual alarm for non-supervisory employees at the facility).

In various embodiments, the system can determine, e.g., by accessing data stored locally or remotely, what users the alarm should be sent to in step 612. In addition, the system may determine a group of devices to send the alarm to (e.g., based on device information such as device location and not based on user information). If the system determines that the alarm should be sent to a group, alert preferences of the users and/or devices of the group may be determined in a manner similar to that which was utilized to determine a user's preferences, as described above. If any alert preference difference exists between the users and/or devices, then the system may accommodate for such differences, for example, by sending different types of alarms for various users/devices, or by defaulting to a system determined alarm for the user/device.

The exemplary systems and methods of this disclosure have been described in relation to a distributed processing network. However, to avoid unnecessarily obscuring the present disclosure, the preceding description omits a number of known structures and devices. This omission is not to be construed as a limitation of the scopes of the claims. Specific details are set forth to provide an understanding of the present disclosure. It should however be appreciated that the present disclosure may be practiced in a variety of ways beyond the specific detail set forth herein.

Furthermore, while the exemplary aspects, embodiments, and/or configurations illustrated herein show the various components of the system collocated, certain components of the system can be located remotely, at distant portions of a distributed network, such as a LAN and/or the Internet, or within a dedicated system. Thus, it should be appreciated, that the components of the system can be combined in to one or more devices, such as a server, or collocated on a particular node of a distributed network, such as an analog and/or digital communications network, a packet-switch network, or a circuit-switched network. It will be appreciated from the preceding description, and for reasons of computational efficiency, that the components of the system can be arranged at any location within a distributed network of components without affecting the operation of the system. For example, the various components can be located in a switch such as a PBX and media server, gateway, in one or more communications devices, at one or more users' premises, or some combination thereof. Similarly, one or more functional portions of the system could be distributed between a communications device(s) and an associated computing device.

Furthermore, it should be appreciated that the various links connecting the elements can be wired or wireless links, or any combination thereof, or any other known or later developed element(s) that is capable of supplying and/or communicating data to and from the connected elements. These wired or wireless links can also be secure links and may be capable of communicating encrypted information. Transmission media used as links, for example, can be any suitable carrier for electrical signals, including coaxial cables, copper wire and fiber optics, and may take the form of acoustic or light waves, such as those generated during radio-wave and infra-red data communications.

Also, while the flowcharts have been discussed and illustrated in relation to a particular sequence of events, it should be appreciated that changes, additions, and omissions to this sequence can occur without materially affecting the operation of the disclosed embodiments, configuration, and aspects.

A number of variations and modifications of the disclosure can be used. It would be possible to provide for some features of the disclosure without providing others.

In yet another embodiment, the systems and methods of this disclosure can be implemented in conjunction with a special purpose computer, a programmed microprocessor or microcontroller and peripheral integrated circuit element(s), an ASIC or other integrated circuit, a digital signal processor, a hard-wired electronic or logic circuit such as discrete element circuit, a programmable logic device or gate array such as PLD, PLA, FPGA, PAL, special purpose computer, any comparable means, or the like. In general, any device(s) or means capable of implementing the methodology illustrated herein can be used to implement the various aspects of this disclosure. Exemplary hardware that can be used for the disclosed embodiments, configurations and aspects includes computers, handheld devices, telephones (e.g., cellular, Internet enabled, digital, analog, hybrids, and others), and other hardware known in the art. Some of these devices include processors (e.g., a single or multiple microprocessors), memory, nonvolatile storage, input devices, and output devices. Furthermore, alternative software implementations including, but not limited to, distributed processing or component/object distributed processing, parallel processing, or virtual machine processing can also be constructed to implement the methods described herein.

In yet another embodiment, the disclosed methods may be readily implemented in conjunction with software using object or object-oriented software development locations that provide portable source code that can be used on a variety of computer or workstation platforms. Alternatively, the disclosed system may be implemented partially or fully in hardware using standard logic circuits or VLSI design. Whether software or hardware is used to implement the systems in accordance with this disclosure is dependent on the speed and/or efficiency requirements of the system, the particular function, and the particular software or hardware systems or microprocessor or microcomputer systems being utilized.

In yet another embodiment, the disclosed methods may be partially implemented in software that can be stored on a storage medium, executed on programmed general-purpose computer with the cooperation of a controller and memory, a special purpose computer, a microprocessor, or the like. In these instances, the systems and methods of this disclosure can be implemented as program embedded on personal computer such as an applet, JAVA® or CGI script, as a resource residing on a server or computer workstation, as a routine embedded in a dedicated measurement system, system component, or the like. The system can also be implemented by physically incorporating the system and/or method into a software and/or hardware system.

Although the present disclosure describes components and functions implemented in the aspects, embodiments, and/or configurations with reference to particular standards and protocols, the aspects, embodiments, and/or configurations are not limited to such standards and protocols. Other similar standards and protocols not mentioned herein are in existence and are considered to be included in the present disclosure. Moreover, the standards and protocols mentioned herein and other similar standards and protocols not mentioned herein are periodically superseded by faster or more effective equivalents having essentially the same functions. Such replacement standards and protocols having the same functions are considered equivalents included in the present disclosure.

The present disclosure, in various aspects, embodiments, and/or configurations, includes components, methods, processes, systems and/or apparatus substantially as depicted and described herein, including various aspects, embodiments, configurations embodiments, subcombinations, and/or subsets thereof. Those of skill in the art will understand how to make and use the disclosed aspects, embodiments, and/or configurations after understanding the present disclosure. The present disclosure, in various aspects, embodiments, and/or configurations, includes providing devices and processes in the absence of items not depicted and/or described herein or in various aspects, embodiments, and/or configurations hereof, including in the absence of such items as may have been used in previous devices or processes, e.g., for improving performance, achieving ease and\or reducing cost of implementation.

The foregoing discussion has been presented for purposes of illustration and description. The foregoing is not intended to limit the disclosure to the form or forms disclosed herein. In the foregoing Detailed Description for example, various features of the disclosure are grouped together in one or more aspects, embodiments, and/or configurations for the purpose of streamlining the disclosure. The features of the aspects, embodiments, and/or configurations of the disclosure may be combined in alternate aspects, embodiments, and/or configurations other than those discussed above. This method of disclosure is not to be interpreted as reflecting an intention that the claims require more features than are expressly recited in each claim. Rather, as the following claims reflect, inventive aspects lie in less than all features of a single foregoing disclosed aspect, embodiment, and/or configuration. Thus, the following claims are hereby incorporated into this Detailed Description, with each claim standing on its own as a separate preferred embodiment of the disclosure.

Moreover, though the description has included description of one or more aspects, embodiments, and/or configurations and certain variations and modifications, other variations, combinations, and modifications are within the scope of the disclosure, e.g., as may be within the skill and knowledge of those in the art, after understanding the present disclosure. It is intended to obtain rights which include alternative aspects, embodiments, and/or configurations to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. A method, comprising:

monitoring, by a microprocessor of a first device, changes in pressure over time at the first device;

detecting, by the microprocessor, a first measurement of a first change in the pressure over time; and providing, by the microprocessor, a first alert based on a potential harmfulness resulting from the first change, wherein the first measurement is below 20 hertz (Hz) and the first alert is based on a harm incurred to a user at a time of the detection of the first measurement.

2. The method of claim 1, wherein the first measurement is inaudible to a user of the first device and the first alert is based on the first measurement being inaudible.

3. The method of claim 1, wherein the first alert is based on a location of a user receiving the first alert.

4. The method of claim 1, further comprising, after the detecting the first measurement, comparing the first measurement with a first threshold to determine a configuration of the first alert.

5. The method of claim 1, further comprising determining properties of the first measurement and indicating, in the first alert, that the potential harmfulness may be a cross-device tracking based on the properties of the first measurement.

6. The method of claim 1, wherein the first alert is provided to a first user at a first location of the first device, wherein a second device of a second user at a second location detects a second measurement of the first change in the pressure over time, wherein the second measurement has a different potential harmfulness, and wherein a second alert is provided to the second user and is different than the first alert based on the different potential harmfulness.

7. The method of claim 1, wherein the first device is at a first location and a user of the first device is at a second location, and wherein the first alert is provided at a second device located with the user based on the user being at the second location and the first device being at the first location.

8. The method of claim 1, wherein the first device is at a first location, wherein users of other devices are at the first location, and wherein the first alert is provided at the other devices based on the location of the other devices.

9. The method of claim 1, further comprising comparing the first measurement with a threshold, wherein if the first measurement does not exceed the threshold, then the first alert is provided to a user of the first device, and wherein if the first measurement exceeds the threshold, then the first alert is provided to a secondary device associated with a location of the first measurement, wherein the secondary device is not located at the location.

10. The method of claim 1, further comprising accessing current location information of devices associated with a location of the first measurement, and providing the first alert to a set of devices whose current location information is within a same area as the location of the first measurement.

11. A system, comprising:

one or more processors;

memory storing one or more programs for execution by the one or more processors, the one or more programs comprising instructions for:

monitoring changes in pressure over time at a first device;

detecting a first measurement of a first change in the pressure over time; and providing a first alert based on a potential harmfulness resulting from the first change, wherein the first measurement is below 20 hertz (Hz) and the first alert is based on a harm incurred to a user at a time of the detection of the first measurement.

12. The system of claim 11, wherein the first alert is based on a location of the first measurement and a location of a user receiving the first alert.

13. The system of claim 11, further comprising, after the detecting the first measurement, comparing the first measurement with a first threshold and a location of a device receiving the first alert in relation to a location of the first measurement to determine a configuration of the first alert.

14. The system of claim 11, further comprising detecting a second measurement in the pressure over time, wherein the first measurement is an inaudible sound that can be used to track personal information, wherein the second measurement is at a different frequency than the first measurement, and providing a second alert that is different than the first alert based on the detection of the second measurement.

15. The system of claim 11, wherein the first alert is provided to local users at a first location of the first device and remote users at a second location, wherein the second location does not experience same properties of the first measurement in the pressure over time, and wherein a second alert that is different from the first alert is provided to the local users.

16. The system of claim 11, wherein the first device is at a first location and a user of the first device is at a second location, wherein the second location does not have any detection of the first measurement, and wherein the first alert is provided at a second device located with the user based on the detecting of the first measurement.

17. The system of claim 11, wherein the first device is at a first location, wherein other devices are at the first location, and wherein the first alert is provided at the other devices based on the other devices being at the first location.

18. The system of claim 11, further comprising comparing the first measurement with a first threshold and a second threshold, wherein if the first measurement exceeds the first threshold, then the first alert is provided to a user of the first device, and wherein if the first measurement exceeds the second threshold, then the first alert is provided to a group of users associated with a location of the first measurement.

19. A tangible and non-transitory computer readable medium comprising microprocessor executable instructions that, when executed by the microprocessor, perform at least the following functions:

monitor changes in pressure over time at a first device;

detect a first measurement of a first change in the pressure over time, wherein the first change is harmful to human health; and provide a first alert configured based on a level of the harmfulness resulting from the first change, wherein the first measurement is below 20 hertz (Hz) and the first alert is based on a harm incurred to a user at a time of the detection of the first measurement.

* * * * *